US005956901A

United States Patent [19]

Kennedy

[11] Patent Number: 5,956,901

[45] Date of Patent: Sep. 28, 1999

[54] GAS DRIVEN HATCH COVER ASSEMBLY

[75] Inventor: Robert E. Kennedy, Monterey, Calif.

[73] Assignee: Northrop Grumman Corporation, Los Angeles, Calif.

[21] Appl. No.: 08/881,638

[22] Filed: Jun. 24, 1997

[51] Int. Cl.[6] ..... E05C 15/02

[52] U.S. Cl. ..... 49/141; 49/21; 49/327; 92/121

[58] Field of Search ..... 49/141, 342, 337, 49/394, 21, 22, 137, 379, 324, 327, 339, 386; 92/121, 125, 258

[56] References Cited

U.S. PATENT DOCUMENTS

| | | | |
|---|---|---|---|
| 2,633,105 | 3/1953 | Lasater | 92/125 |
| 3,023,741 | 3/1962 | O'Connor | 92/125 |
| 3,066,654 | 12/1962 | Matt | 92/125 |
| 3,676,954 | 7/1972 | Rapport et al. | 49/337 X |
| 3,680,982 | 8/1972 | Jacobellis | 417/392 |
| 3,696,713 | 10/1972 | Ragard | 92/121 |
| 3,731,598 | 5/1973 | Brignon et al. | 92/125 |
| 4,009,644 | 3/1977 | Higuchi et al. | 92/125 |
| 4,495,856 | 1/1985 | Sollami | 92/125 |
| 4,565,119 | 1/1986 | Higuchi | 92/121 X |
| 4,633,759 | 1/1987 | Schulze | 92/121 X |
| 4,817,504 | 4/1989 | Lieberman | 92/125 |
| 4,819,830 | 4/1989 | Schultz | 220/371 |
| 4,864,917 | 9/1989 | Methot | 92/55 |
| 4,893,700 | 1/1990 | Gramss | 92/121 X |
| 5,040,453 | 8/1991 | Eicher et al. | 92/125 X |
| 5,465,862 | 11/1995 | Devlin | 49/379 X |
| 5,634,392 | 6/1997 | Najork et al. | 92/121 |

*Primary Examiner*—Daniel P. Stodola
*Assistant Examiner*—Khoa Tran
*Attorney, Agent, or Firm*—Walter G. Sutcliff

[57] ABSTRACT

A hatch assembly having a hatch cover biased to a normally closed position. The hatch cover is connected to an impeller contained and rotatable within a impeller chamber of a housing. When the cover is to be opened, pressurized gas is introduced into the housing causing rotation of the impeller. By virtue of the coupling of the impeller to the hatch cover, the rotation causes the hatch cover to open. After opening, the hatch cover may thereafter be closed by a spring bias forming part of the coupling arrangement.

8 Claims, 6 Drawing Sheets

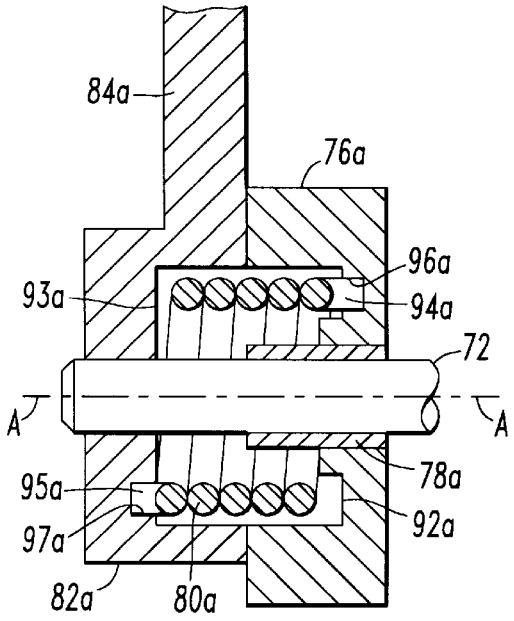
FIG.5A
FIG.6A
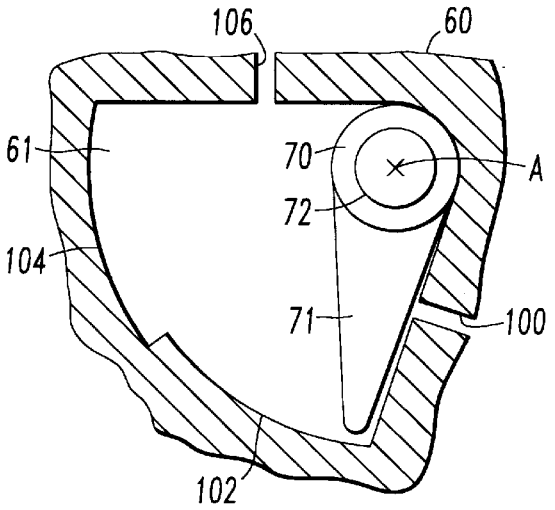
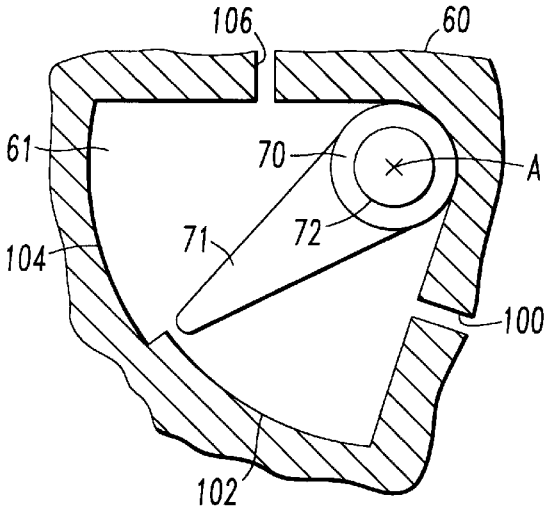
FIG.6B
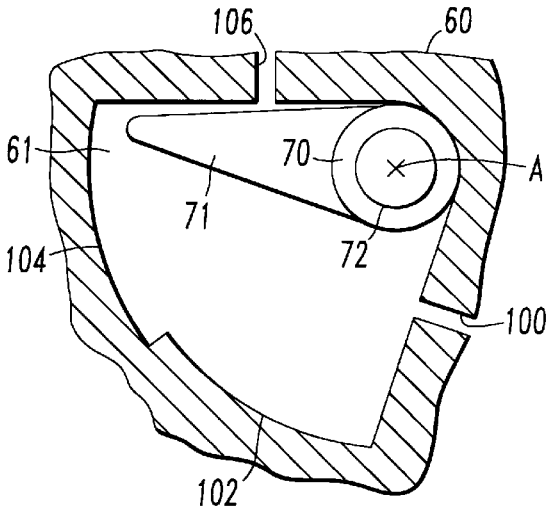
FIG.6C

GAS DRIVEN HATCH COVER ASSEMBLY

BACKGROUND OF THE INVENTION

1. Field of the Invention

The invention in general relates to closure devices, and more particularly to a hatch assembly which may be utilized as the protective cover of a vertical missile launch system.

2. Description of Related Art

A typical vertical missile launch system may include an array of adjacent vertical cells each containing a canister having a ready to fire missile preloaded into the canister. Each cell includes, at its upper end, a hatch cover member for protection purposes, and which is opened when a missile is to be launched.

Current hatch assembly designs utilize electric motors for opening the hatch covers, however, such motor driven arrangements are heavy, complex, are sensitive to certain operational conditions and require periodic maintenance and adjustment.

The present invention provides for an improved hatch assembly which is simple, rugged, self contained and compact with high actuation reliability not dependent upon motors, linkages or other drives.

SUMMARY OF THE INVENTION

A hatch assembly is provided which includes a hatch frame and a hatch cover for normally closing off the hatch frame. An impeller housing, having an impeller chamber, is connected to the hatch frame, and may be a separate part fastened to the hatch frame or may be cast as one piece with it.

Disposed within the impeller chamber is an impeller rotatable about an axis, which would be horizontal for a vertical launch system. The impeller housing has a gas inlet for admitting pressurized gas into the chamber to cause rotation of the impeller. The source of the gas is preferably an electrically operated pyrotechnic gas charge device.

Connecting means connect the impeller with the hatch cover whereby rotation of the impeller, caused by the gas pressurization, rotates the hatch cover to an open position. If the requirement exists for the hatch cover to thereafter close, means may be provided for the controlled relieving of the pressure within the impeller housing as the door reaches an open position.

BRIEF DESCRIPTION OF THE DRAWINGS

FIG. 5A is an axial cross sectional view of a portion of the assembly of FIG. 5.

FIGS. 6A, 6B and 6C are cross-sectional views of the impeller housing, with impeller, during a gas pressurization and depressurization operation.

DESCRIPTION OF THE PREFERRED EMBODIMENT

Figure 1:
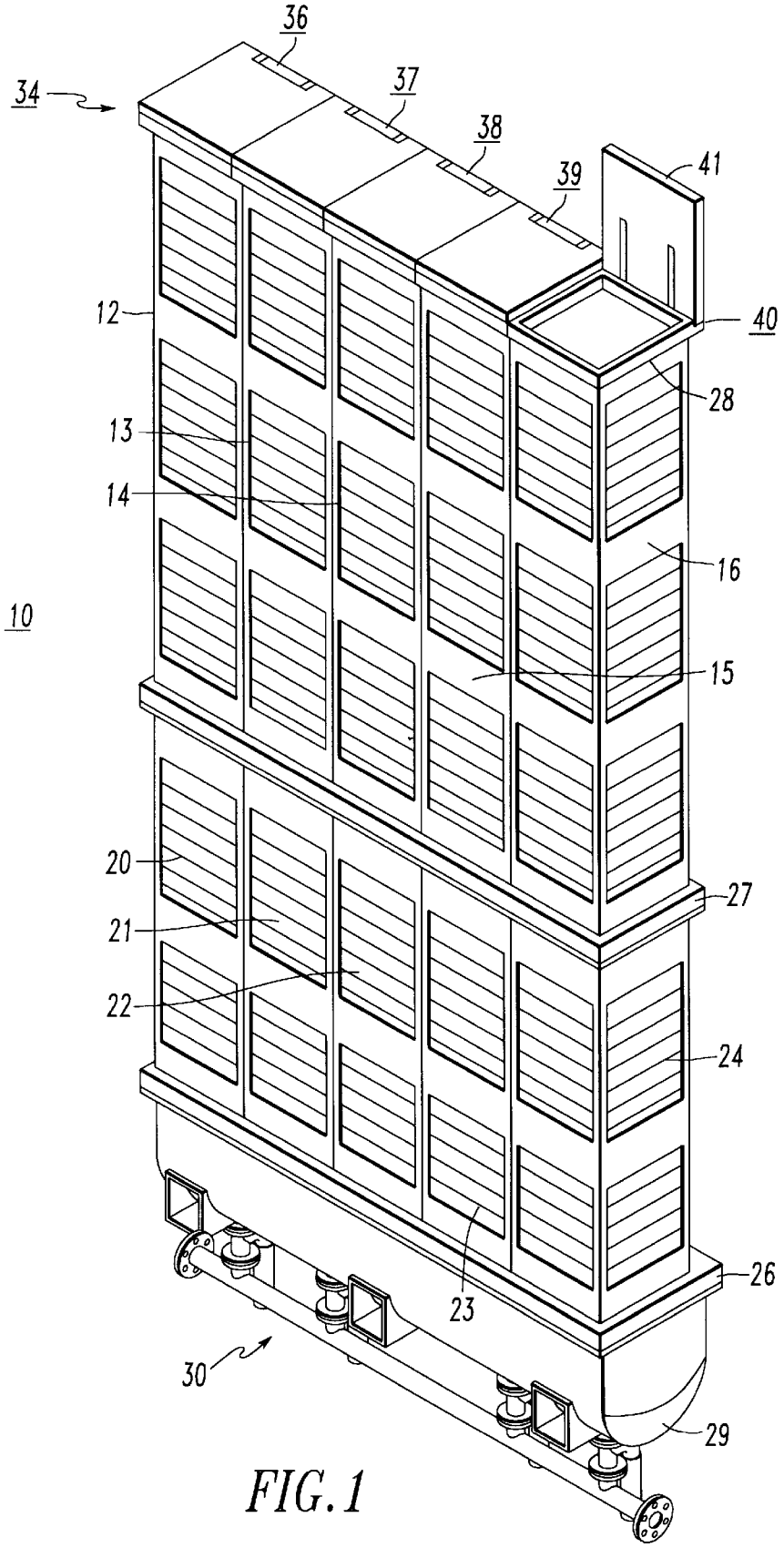
FIG. 1 is an isometric view of one type of system in which the present invention may be used.

In the drawings, which are not necessarily to scale, like or corresponding parts are denoted by like or corresponding reference numerals.

Although the present invention may be utilized as a closure means for a variety of structures, it will be described, by way of example, with respect to a vertical missile launcher, such as illustrated in FIG. 1.

As seen in FIG. 1, missile launcher apparatus 10 includes an array of adjacent sleeves 12 to 16, each accommodating a respective missile containing canister 20 to 24. As seen through cutouts in the walls of the sleeves, the canisters 20 to 24 extend from the lower, or breech end of its respective sleeve, to the upper, or muzzle end of the sleeve. The sleeves are held together by a series of frames 26 to 28 and the breech ends of all of the sleeves are collectively connected to a common plenum 29 having a cooling water supply 30.

In order to provide ballistic and environmental protection for the muzzle ends of the sleeves there is provided a hard hatch arrangement 34 which includes individually operable hatch assemblies 36 to 40, covering respective sleeves 12 to 16. End hatch assembly 40 is seen with its hatch cover 41 in an open condition ready for a firing of a missile from canister 24.

Figure 2:
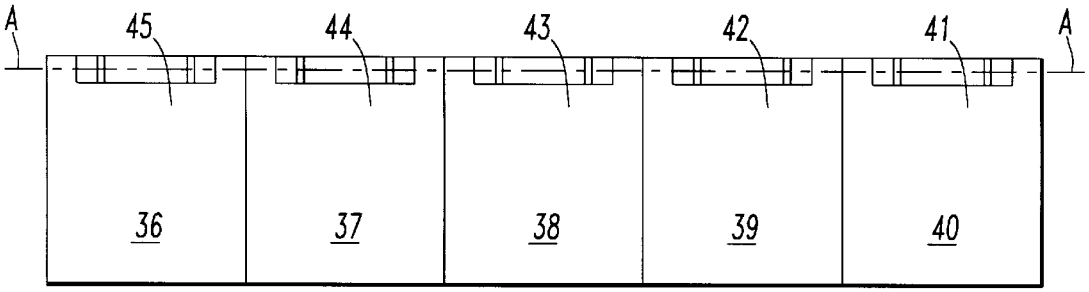
FIG. 2 is a plan view.
Figure 3:
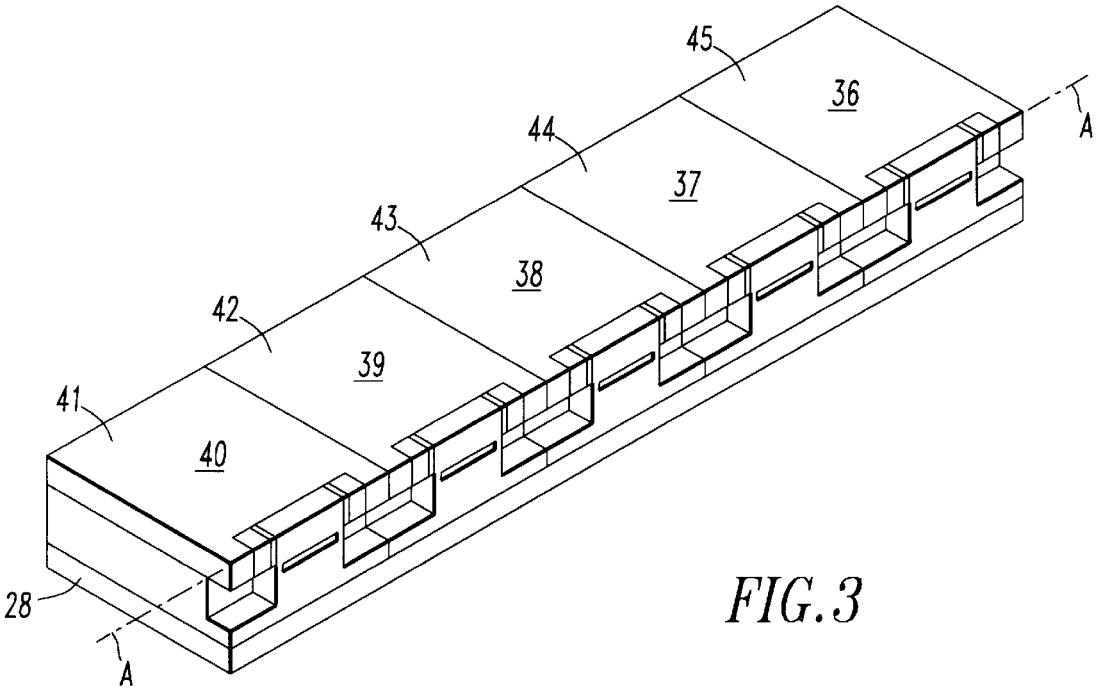
FIG. 3 is an isometric view of a hatch assembly in accordance with one embodiment of the present invention.

FIG. 2 illustrates a plan view of the arrangement of hatches 36 to 40, with respective hatch covers 41 to 45, and FIG. 3 shows the arrangement from the opposite side as that presented in FIG. 1. Each of the hatch covers 41 to 45, when activated, is opened by rotation about a common axis A.

Figure 4:
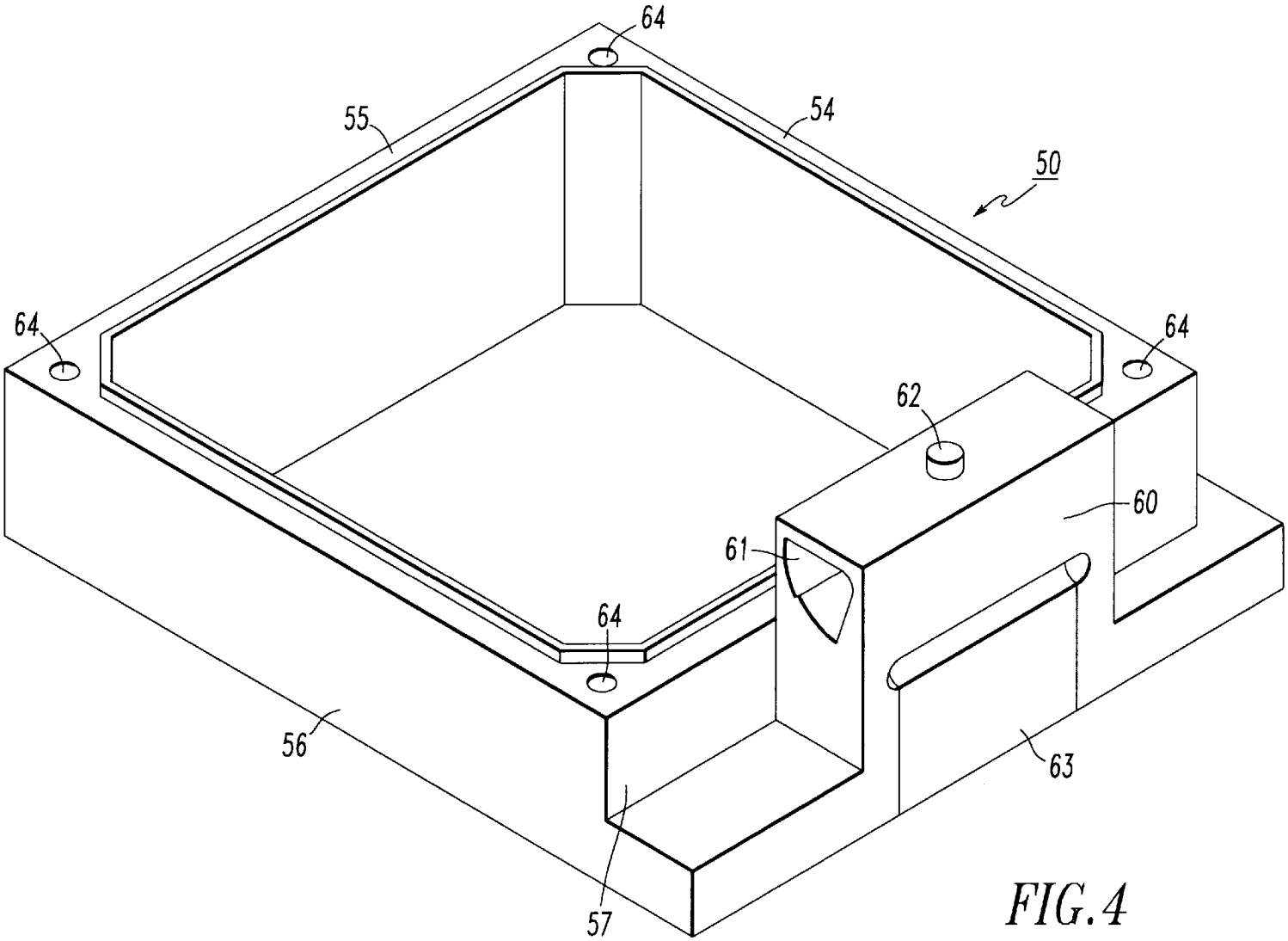
FIG. 4 is a view of a hatch frame.
Figure 5:
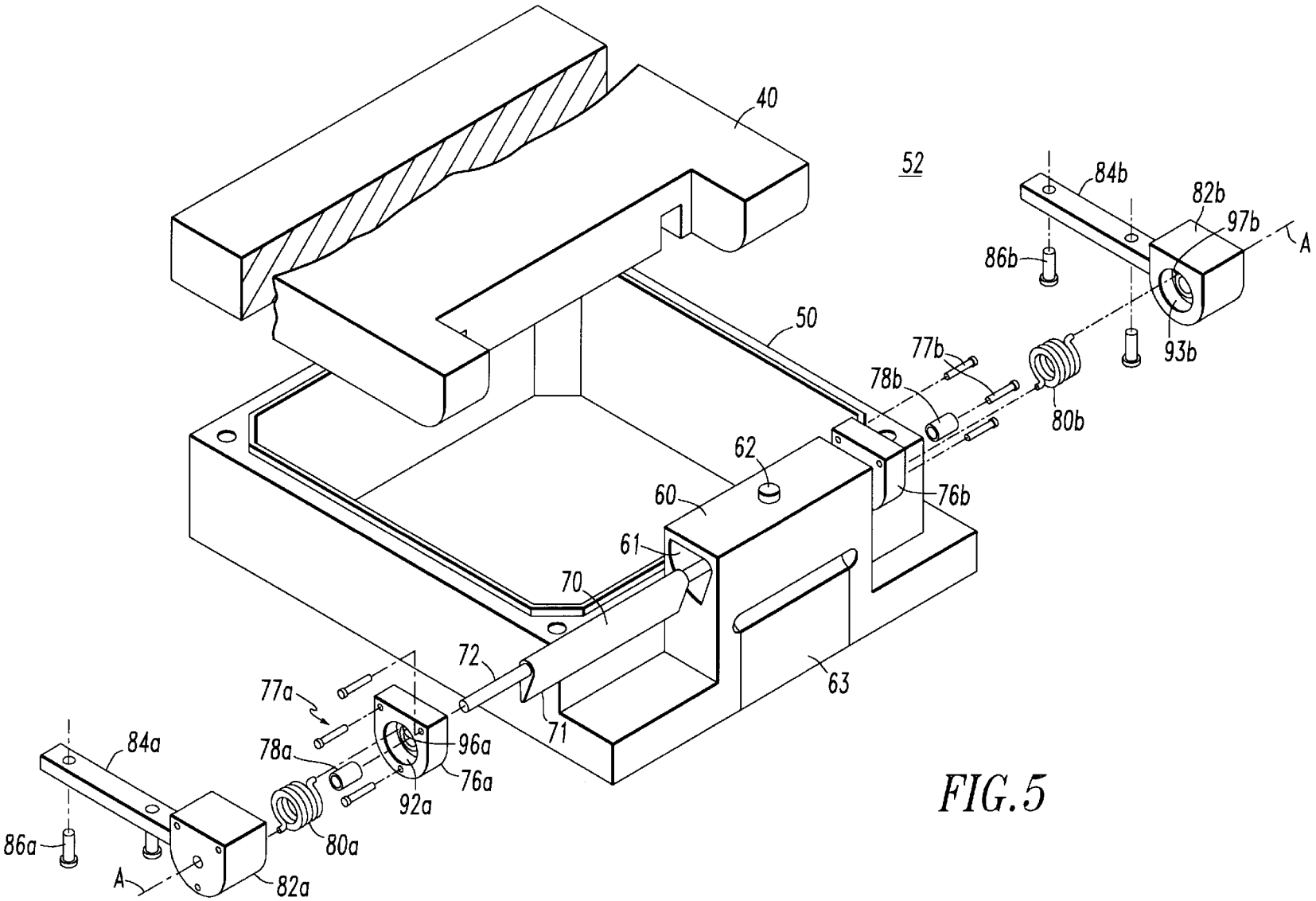
FIG. 5 is an exploded view of a hatch assembly in accordance with one embodiment of the present invention.

FIG. 4 illustrates a frame member 50 of a typical single hatch assembly 52 shown in FIG. 5. The frame 50 includes four walls 54 to 57, as well as an impeller housing 60 connected to one of the walls, 57. The impeller housing 60, which has an internal impeller chamber 61 and adjustable gas escape valve 62, may be fastened to a frame wall, or if the unit is fabricated as a cast metal, the impeller housing may be an integral part of the frame 50. The rear of impeller housing 60 additionally includes a closure, such as a removable panel or door 63 in order to allow access to the rear of the housing. Frame 50 may be secured to the top of the vertical launcher 10 (FIG. 1) by means of fasteners which pass through apertures 64, in the corners of the frame 50.

As seen in the exploded view of the hatch assembly 52, in FIG. 5, the arrangement includes an impeller 70 having an impeller blade 71 and an impeller shaft 72 all of which fit into the impeller chamber 61. Left (as viewed in FIG. 5) end cap 76*a* and right end cap 76*b* are affixed to the ends of impeller housing 60 by means of fasteners 77*a* and 77*b* and receive respective bearings 78*a* and 78*b* for rotational support of the shaft 72.

Springs 80*a* and 80*b* are connected to respective end caps 76*a* and 76*b* as well as to hubs 82*a* and 82*b* of hatch arms 84*a* and 84*b*. Shaft 72 extends through bearings 78*a* and 78*b* in end caps 76*a* and 76*b*, passes through springs 80*a* and 80*b* and is secured to respective hatch arm hubs 82*a* and 82*b* by any number of well known fastening devices such as keyways, splines or pins, by way of example.

Fasteners 86*a* and 86*b* secure the hatch arms 84*a* and 84*b* to a hatch cover 90 which is normally biased to close off the hatch opening. More particularly, FIG. 5A illustrates an axial cross sectional view of the left side coupling arrangement for transmitting rotation of shaft 72 of impeller 70 to the hatch cover to open and close it. Although not shown, the right side coupling arrangement would be similar.

As seen in FIG. 5A, one end of spring 80*a* fits into a recess 92*a* within the end cap 76*a*. The other end of the spring fits into a similar recess 93*a* in hub 82*a*. Projections 94*a* and 95*a* on opposite ends of spring 80*a* (which may be the ends of the spring 80*a* bent by 90°), fit into respective niches 96*a* and 97*a* in recesses 92*a* and 93*a*. In this manner the spring is pegged and will torsionally deform when shaft 72 is rotated and the hatch cover 90 opened, and will apply a closing bias force thereafter, as will be explained, to assume its normal rest position to thereby close the hatch cover.

FIGS. 6A to 6C illustrate the operation of the apparatus, in accordance with one embodiment of the invention. In FIG. 6A pressurized gas, supplied via gas passageway 100, is admitted into impeller chamber 61 and initiates rotation of shaft 72 and connected blade 71. The tip of blade 71 is adjacent to wall surface 102 of impeller chamber 61 during the first part of the rotation and substantially all of the gas pressure acts to drive the rotation.

At the blade position illustrated in FIG. 6B, the blade 71 will encounter wall surface 104, which is more distant from the tip of the blade. Accordingly, some of the provided gas will bypass the blade and escape from the impeller chamber 61 via gas passageway 106, thus slowing down the shaft rotation and hatch cover opening.

At the end of its stroke, as illustrated in FIG. 6C, pressurized gas supply via passageway 100 will have ceased and the gas previously driving the impeller 70 will have exited the chamber 61. At this point the missile will have been launched and the spring force will have commenced closure of the hatch cover.

The rate of depressurization of the impeller chamber 61 is governed by the adjustable gas escape valve 62 (FIG. 5) which operates as a controlled aperture or vent. The pressurized gas which is introduced into passageway 100 may be supplied by an on board gas supply connected to a suitable fitting on impeller housing 60, or as an alternative, the gas may be supplied by an individual, one shot gas charge device such as an electrically activated pyrotechnic gas charge device (PGCD). In the present embodiment, for a single event opening a PGCD is utilized and preferably having a redundant PGCD. For a multiple event opening, such as for a missile canister having a plurality of missiles to be launched at different times, a plurality of PGCDs are utilized.

Figure 7:
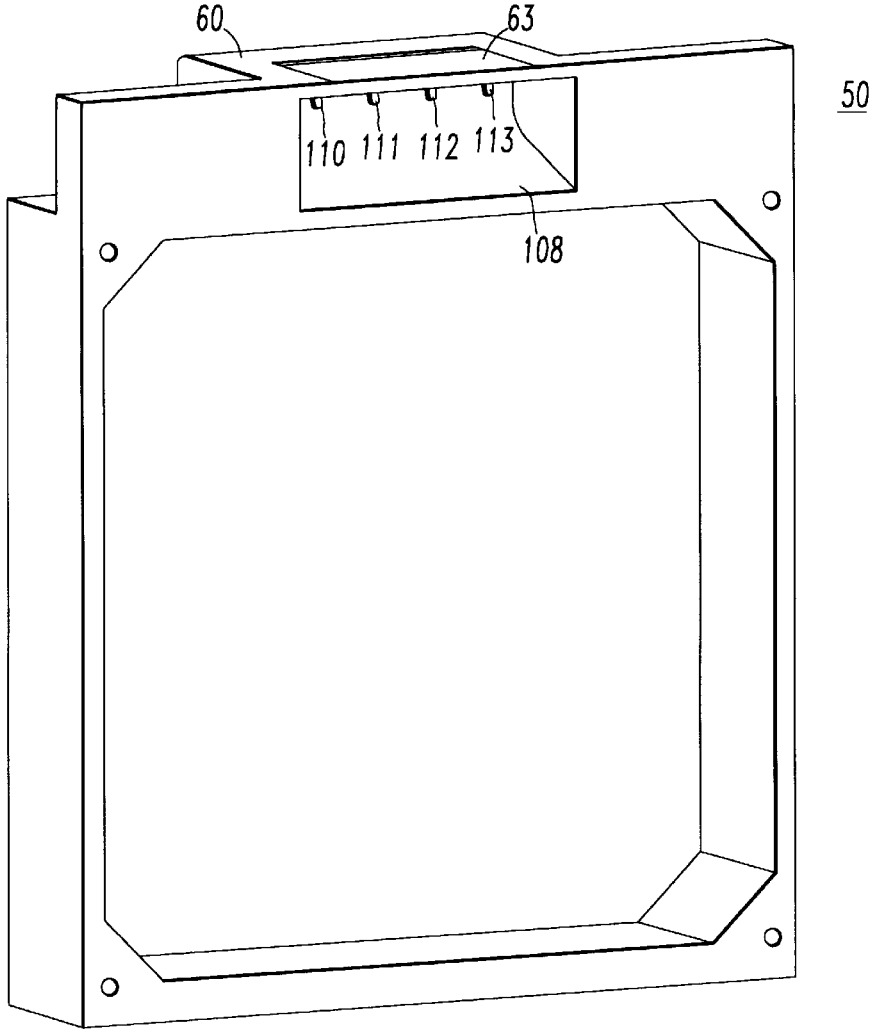
FIG. 7 is a view of the underside of the hatch frame illustrated in FIG. 4.

By way of example, FIG. 7 illustrates a bottom view of the hatch frame 50 which includes a PGCD receiving cavity 108. Within the cavity 108, and connected to respective passageways such as passageway 100 (FIG. 6A) is a plurality of fittings 110 to 113 each for receiving a respective PGCD which may be installed by removing closure 63.

Figure 8:
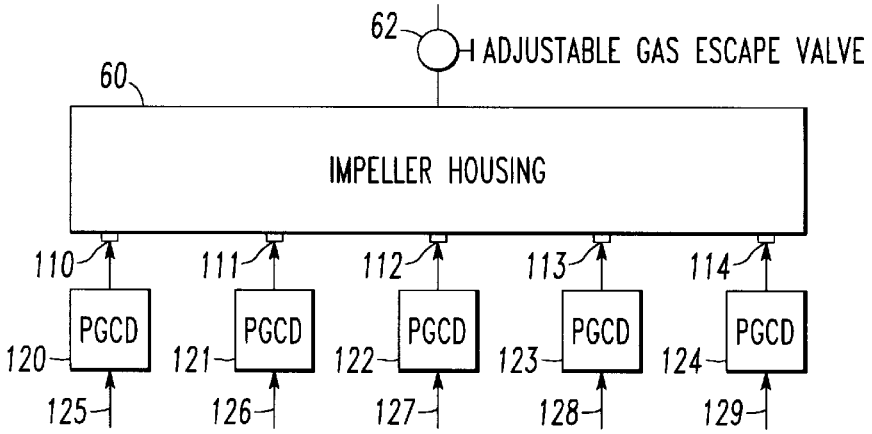
FIG. 8 is a block diagram illustrating gas pressurization devices.

With reference to FIG. 8, for a four event opening four PGCDs 120 to 123 are illustrated connected to respective fittings 110 to 113. For redundancy purposes, a fifth PGCD 124 connected to fitting 114 is utilized. Each PGCD is activated by means of an electrical signal, supplied at time of launch, via respective signal lines 125 to 129.

Although the present invention has been described with a certain degree of particularity, it is to be understood that various substitutions and modifications may be made without departing from the spirit and scope of the invention as defined in the appended claims. By way of example, for certain uses other than missile launches it may not be necessary to close the hatch cover after an opening. In such case, controllable gas venting and the biasing springs may be eliminated.

What is claimed is:

1. A hatch assembly, comprising:

(A) a hatch frame;

(B) a hatch cover for closing off said hatch frame;

(C) an impeller housing connected to said frame and having an impeller chamber;

(D) an impeller disposed and rotatable in said chamber and rotatable about an axis;

(E) a plurality of gas inlet means for admitting pressurized gas to said chamber to cause rotation of said impeller;

(F) a plurality of gas charge devices connected to respective ones of said gas inlet means; and (G) connecting means connecting said impeller with said hatch cover whereby rotation of said impeller rotates said hatch cover to an open position.

2. An assembly according to claim 1 wherein:

(A) said impeller housing is an integral part of said frame.

3. An assembly according to claim 1 which includes:

(A) means for relieving gas pressure within said chamber as said hatch cover reaches an open position.

4. An assembly according to claim 1 wherein:

(A) said means for relieving gas pressure is a gas passageway leading from said chamber to the outside of said chamber.

5. An assembly according to claim 4 which includes:

(A) an adjustable gas escape valve connected to said passageway.

6. An assembly according to claim 1 wherein:

(A) said connecting means includes at least one spring biasing said hatch cover to a closed position.

7. An assembly according to claim 1 wherein:

(A) said connecting means includes a hatch arm connected to said hatch cover;

(B) said hatch arm including a hub portion connected to said rotatable impeller.

8. An assembly according to claim 1 wherein:

(A) said gas charge devices are electrically activated.

* * * * *